US010018170B2

(12) United States Patent
Marechal et al.

(10) Patent No.: US 10,018,170 B2
(45) Date of Patent: Jul. 10, 2018

(54) INTEGRATED ARRANGEMENT OF A HIGH-PRESSURE VALVE AND AN INJECTION RAIL

(71) Applicant: DELPHI TECHNOLOGIES IP LIMITED, St. Michael (BB)

(72) Inventors: Michel Marechal, Chouzy sur Cisse (FR); Frederic Sauvage, Beaugency (FR); Jean-Luc Rouet, Chitenay (FR); Mattieu Magre, Orleans (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 56 days.

(21) Appl. No.: 14/908,607

(22) PCT Filed: Jul. 21, 2014

(86) PCT No.: PCT/EP2014/065628

§ 371 (c)(1),
(2) Date: Mar. 23, 2016

(87) PCT Pub. No.: WO2015/014654

PCT Pub. Date: Feb. 5, 2015

(65) Prior Publication Data

US 2016/0273503 A1 Sep. 22, 2016

(30) Foreign Application Priority Data

Jul. 31, 2013 (FR) ..... 13 57585

(51) Int. Cl.
*F02M 63/00* (2006.01)
*F02M 63/02* (2006.01)
(Continued)

(52) U.S. Cl.
CPC ..... *F02M 63/0052* (2013.01); *F02M 55/025* (2013.01); *F02M 61/168* (2013.01);
(Continued)

(58) Field of Classification Search
CPC ..... F02M 55/025; F02M 61/168; F02M 63/0017; F02M 63/023; F02M 2200/28;
(Continued)

(56) References Cited

U.S. PATENT DOCUMENTS 5,005,878 A * 4/1991 Smith ..... F02M 55/004 285/319
5,076,499 A * 12/1991 Cranford ..... F02M 51/0685 239/585.2
(Continued)

FOREIGN PATENT DOCUMENTS

DE 102007053800 A1 5/2009
EP 1331425 A1 7/2003
(Continued)

OTHER PUBLICATIONS

International Search Report dated Feb. 10, 2014.

*Primary Examiner* — Craig Schneider
*Assistant Examiner* — P. Macade Nichols
(74) *Attorney, Agent, or Firm* — Joshua M. Haines

(57) ABSTRACT

An arrangement of a high-pressure valve at the end of a common rail of a fuel injection system, a high-pressure channel of the rail opening out at one extremity of the rail, includes a throttle stopper arranged at the extremity of the rail. An output orifice restricts a section of the high-pressure channel and a valve seat is positioned in the throttle stopper. The output channel is fully formed inside the valve body.

2 Claims, 1 Drawing Sheet

(51) Int. Cl.
*F02M 55/02* (2006.01)
*F02M 61/16* (2006.01)

(52) U.S. Cl.
CPC .... *F02M 63/0017* (2013.01); *F02M 63/0036* (2013.01); *F02M 63/023* (2013.01); *F02M 2200/28* (2013.01); *F02M 2200/8023* (2013.01)

(58) Field of Classification Search
CPC ..... F02M 2200/8023; F02M 63/0052; F02M 63/0036
USPC ..... 137/533.11; 251/129.14, 360
See application file for complete search history.

(56) References Cited

U.S. PATENT DOCUMENTS

| | | | | |
|---|---|---|---|---|
| 5,549,274 | A * | 8/1996 | Buchanan | F02M 59/466 251/129.14 |
| 6,152,422 | A * | 11/2000 | Staib | F16K 31/0637 137/596.17 |
| 2012/0288389 | A1 | 11/2012 | Kuroyanagi et al. | |
| 2014/0070028 | A1* | 3/2014 | Rochas | F02M 63/0052 239/533.3 |
| 2015/0260296 | A1 | 9/2015 | Kuroyanagi et al. | |
| 2017/0058887 | A1 | 3/2017 | Kuroyanagi et al. | |

FOREIGN PATENT DOCUMENTS

| | | | |
|---|---|---|---|
| WO | 2008/113776 | A1 | 9/2008 |
| WO | 2012/055638 | A1 | 5/2012 |

* cited by examiner

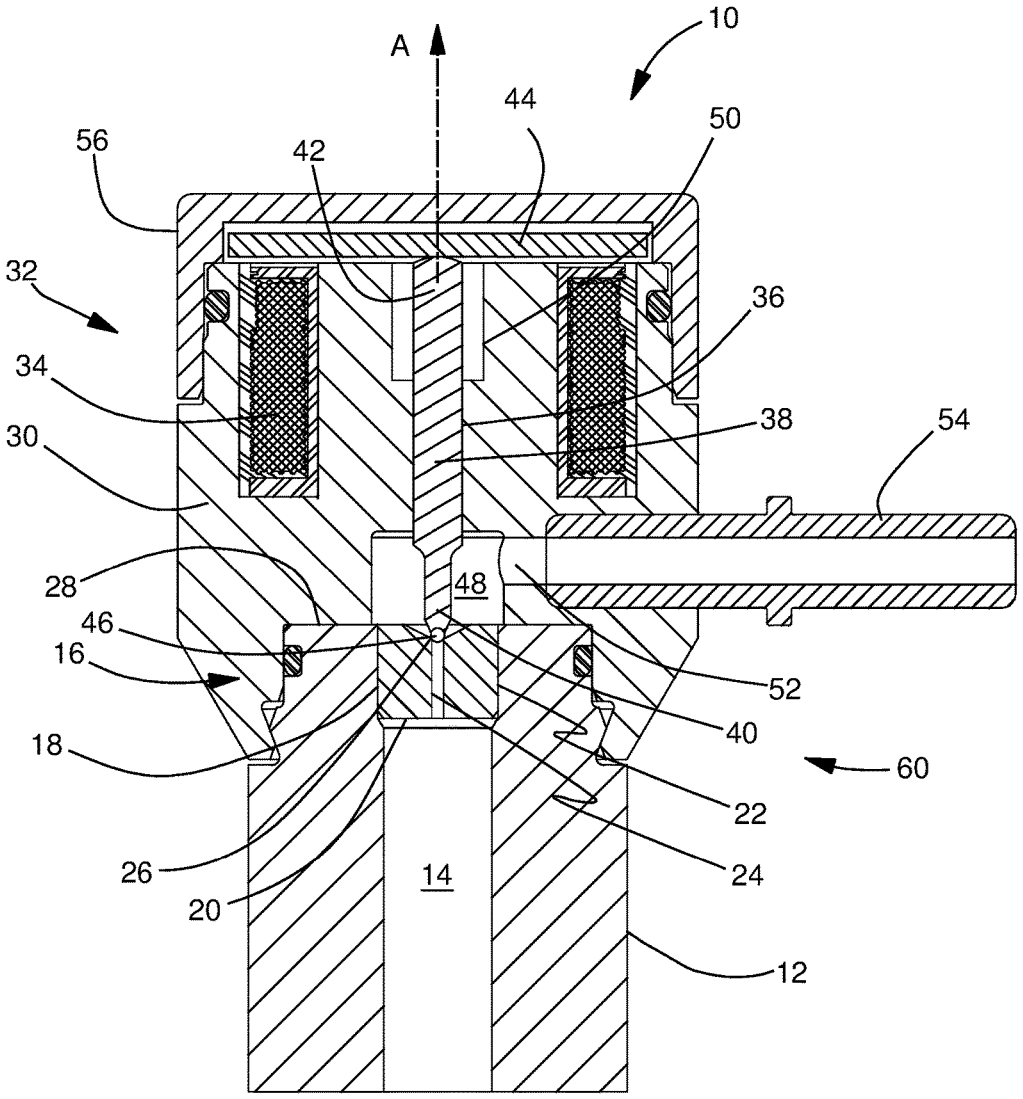
10
A
44
50
56
42
32
36
34
38
54
30
28
48
46
16
52
40
18
60
22
26
24
14
20
12

INTEGRATED ARRANGEMENT OF A HIGH-PRESSURE VALVE AND AN INJECTION RAIL

CROSS REFERENCE TO RELATED APPLICATIONS

This application is a national stage application under 35 USC 371 of PCT Application No. PCT/EP2014/065628 having an international filing date of Jul. 21, 2014, which is designated in the United States and which claimed the benefit of French Patent Application No. 1357585 filed on Jul. 31, 2013, the entire disclosures each are hereby incorporated by reference in their entirety.

TECHNICAL DOMAIN

The present invention relates to a valve limiting the pressure of the fuel in the common rail of a fuel injection system.

TECHNOLOGICAL BACKGROUND TO THE INVENTION

Common-rail fuel injection systems have a high-pressure valve positioned at the end of the rail. The valve is normally closed and is designed to open when the pressure in the rail exceeds a predetermined threshold.

A valve in which the body includes an electromagnet cooperating with a needle sliding axially to control an output orifice formed in a seat that is arranged inside the body is known from application FR1260350. The valve body is partially threaded and screwed onto the extremity of the rail. The output orifice communicates with a low-pressure chamber arranged in the valve body about the extremity of the needle, and a return channel passes radially through the valve body and the rail between the low-pressure chamber and a low-pressure tank. This arrangement is bulky, requires extensive additional machining on the valve and the rail, and requires angular matching to align the sections of the return channel of the valve body and of the rail.

SUMMARY OF THE INVENTION

The present invention is intended to address these problems by proposing an arrangement of a high-pressure valve at one extremity of the common rail of a fuel injection system. The high-pressure channel of the rail opens out at said extremity of the rail and the valve has a body in which a blocking member, that is movable along a main axis, is provided to cooperate with a seat surrounding an output orifice such as to close said orifice or to open same when the pressure of the fuel in the rail exceeds a predetermined threshold. The fuel is then discharged to an output channel.

The arrangement also includes a throttle stopper arranged at the extremity of the rail. The output orifice restricting the section of the high-pressure channel and the valve seat are both contained within the throttle stopper. Furthermore, the output channel is fully formed within the valve body.

The valve also includes a chamber inside the body arranged such as to receive the fuel discharged from the output orifice, the output channel extending from said chamber and passing through the body of the valve. More specifically, the output channel extends radially through the valve body.

Furthermore, the valve is an active valve, the blocking member cooperating with an actuator, such as an electromagnet.

More specifically, the blocking member is a needle with a pointed extremity designed to cooperate with the seat. Alternatively, the blocking member may include a push rod acting on a ball designed to cooperate with the seat.

Moreover, the valve body is provided with attachment means enabling the valve to be rigidly connected to the rail. Specifically, the valve is clipped to the end of the rail, such that the valve can be turned in relation to the rail to adjust the angular orientation of same.

The invention also relates to a high-pressure valve designed to be positioned at the end of the common rail of a fuel injection system.

SHORT DESCRIPTION OF THE DRAWINGS

Other features, objectives and advantages of the invention are set out in the detailed description below, with reference to the attached drawing showing an axial cross section of a valve according to the invention, given by way of nonlimiting example.

DESCRIPTION OF PREFERRED EMBODIMENTS

A first nonlimiting embodiment of the arrangement 60 of a valve 10 at the end of the common rail 12 of a fuel injection system is described below with reference to FIG. 1.

The rail 12 extends along a main axis A and the high-pressure channel 14, which extends axially inside the rail 12, opens out at one extremity 16 of the rail 12 in a counterbore 18 forming a radial surface 20 with the channel 14. A tubular cylindrical throttle stopper 22 is positioned in the counterbore 18 and butts against the radial surface 20. Thus arranged, the throttle stopper 22 is flush with the extremity 16 of the rail. The external diameter of the throttle stopper fits the external diameter of the counterbore 18 tightly such that the throttle stopper 22 is assembled and held in place by pressing. The throttle stopper 22 has an output orifice 24 extending axially A and limiting the section of the channel 14, the output orifice 24 widening out into a cone shape to form a seat 26. Alternatively, the throttle stopper may be attached to the rail by means other than press fitting. It may notably be screwed into the counterbore 18. It may also be glued in position.

The valve 10 is positioned at the extremity of the rail 12, the valve body 30 being clipped to the end of the rail 12. Clipping the valve body 30 to the rail 12 requires matching surfaces that are described below and that are also detailed in application FR1357558, filed today.

The valve body 30 is cylindrical overall, made of magnetic steel and forms the shell of an electromagnet 32, the coil 34 of which is arranged axially inside the body 30. The body 30 also has an open axial bore 36 containing a needle 38 with a pointed extremity 40 that cooperates with the seat 26, the other remote extremity 42 of same being rigidly connected to a flat disc-shaped magnetic core 44 covering the coil 34. In the embodiment shown, the needle 38 acts as a push rod on the ball 46 that cooperates with the seat 26. Other electromagnet structures may also be used, including the conventional assembly in which the core is arranged axially in the center of the coil.

Furthermore, an axial cylindrical chamber 48 is formed in the body 30 facing the seat 26. The bore 36 opens out into the chamber 48 and the needle 38 extends through the center of said chamber 48. At the other extremity, the bore 36 opens out into another axial counterbore 50 such as to reduce the central portion of the bore that guides the needle 38 axially. A spring (not shown) may be positioned in this other bore 50 and compressed between the bottom of the bore 50 and the core 44 such as to permanently press the needle 38 towards the open position.

As shown in the FIGURE, the high-pressure channel 14, the throttle stopper 22, the output orifice 24, the needle 38, the bore 36, the cylindrical chamber 48 and said other counterbore 50 are coaxial A. Furthermore, an output channel 52 extends radially from the cylindrical chamber 48 and passes through the body 30, where it is extended by a discharge pipe 54. As shown in the FIGURE, the chamber 48 is entirely formed within the body 30 and the output channel 52 extends entirely within the body 30 and shares no common portions with the rail 12. The valve body 30 is moreover covered by a bell-shaped cover 56 attached to the body 30 and sealing the magnetic core 44 by means of a first O-ring.

The clipping surfaces are described below. The body 30 is arranged at the end 28 of the rail 12 by means of a male joint for the rail 12 and a female joint for the valve 10. According to the downwards orientation shown in the FIGURE, and without thereby limiting the invention, the body 30 and the rail 12 are engaged by means of complementary cylindrical surfaces. The seal between the valve and the rail is provided by another O-ring. The body 30 also has a groove in which an annular projection of the rail is positioned. The projection and the groove are in elastic contact via a conical surface, the top of which is on the main axis A and positioned on the side of the rail. To arrive at this arrangement, the body is deformed by being elastically extended such that the projection is engaged in the groove. Once the engagement is achieved, the body partially regains its shape while retaining a residual elastic deformation that generates an axial force on the body that is directed towards the rail, pressing the valve against the extremity of the rail. Positioning by elastic deformation can be facilitated by cutting sections out of the body to form crenellated angular sections that can be deformed more easily than a continuous cylinder. Once in place, the valve is held axially against the extremity 16 of the rail and radially by the cylindrical surfaces. The valve can then be turned in relation to the rail in order to adjust the angular orientation of the discharge pipe 54.

The valve 10 described above is an active valve in that the needle 38 cooperates with an electromagnet. In an alternative not shown, the valve may be a passive valve, the electromagnet being simply replaced by a spring permanently pressing the needle towards the seat, the valve opening as a function of the pressure of the fuel in the rail and the stiffness of the spring.

Operation of the valve is described briefly below. The electromagnet is powered such that the core 44 is attracted towards the coil 34 and the needle 38 blocks the output orifice 24 by bearing against the seat 26. In the embodiment shown in the FIGURE, the needle presses the ball against the seat. When the pressure of the fuel in the high-pressure channel 14 exceeds a predetermined threshold, the electromagnet stops acting on the needle 38, which slides inside the bore away from the seat 26. The fuel can then be discharged from the high-pressure channel 14 by passing successively through the output orifice 24, the cylindrical chamber 48, the output channel 52 and the discharge pipe 54. When the pressure in the channel drops back below the threshold, the coil 34 is again powered and the needle 38 closes the output orifice 24 again.

Passive valves work in a similar way, the loading of the compression spring determining the pressure threshold beyond which the fuel pushes the needle back.

The invention claimed is:

1. An arrangement of a high-pressure valve at one extremity of a common rail of a fuel injection system, a high-pressure channel of the rail opening out at the extremity of the rail, the arrangement comprising:

a body;

a blocking member within the body, the blocking member being moveable along a main axis such that the blocking member cooperates with a seat surrounding an output orifice so as to close the output orifice and to open the output orifice when the pressure of the fuel in the rail exceeds a predetermined threshold such that fuel is discharged toward an output channel when the blocking member opens the output orifice; and a throttle stopper is flush with the extremity of the rail;

wherein the output orifice restricts a section of the high pressure channel;

wherein the valve seat is positioned in the throttle stopper;

wherein the output channel is fully formed inside the body;

wherein the valve body is provided with attachment means enabling the valve to be rigidly connected to the rail; and wherein the valve is clipped to the end of the rail.

2. The arrangement as claimed in claim 1, wherein the valve can be turned in relation to the rail to adjust the angular orientation of same.

* * * * *